US009959718B2

(12) United States Patent
Hendrie

(10) Patent No.: US 9,959,718 B2
(45) Date of Patent: May 1, 2018

(54) DOOR ALARM

(71) Applicant: William S. Hendrie, Scarborough (CA)

(72) Inventor: William S. Hendrie, Scarborough (CA)

( * ) Notice: Subject to any disclaimer, the term of this patent is extended or adjusted under 35 U.S.C. 154(b) by 0 days. days.

(21) Appl. No.: 15/303,387

(22) PCT Filed: Apr. 14, 2015

(86) PCT No.: PCT/CA2015/050307
§ 371 (c)(1),
(2) Date: Oct. 11, 2016

(87) PCT Pub. No.: WO2015/157860
PCT Pub. Date: Oct. 22, 2015

(65) Prior Publication Data

US 2017/0032634 A1 Feb. 2, 2017

Related U.S. Application Data

(60) Provisional application No. 61/980,082, filed on Apr. 16, 2014.

(51) Int. Cl.
*G08B 13/08* (2006.01)
*H01H 35/02* (2006.01)
(Continued)

(52) U.S. Cl.
CPC ..... *G08B 13/08* (2013.01); *E05B 13/001* (2013.01); *E05B 45/06* (2013.01); *G08B 25/08* (2013.01); *H01H 35/02* (2013.01); *E05B 2045/067* (2013.01); *E05B 2045/0615* (2013.01); *G08B 3/1008* (2013.01); *G08B 5/222* (2013.01); *G08B 5/36* (2013.01)

(58) Field of Classification Search
CPC ..... G08B 13/08; G08B 25/08; E05B 13/001; E05B 45/06; H01H 35/02
USPC ..... 340/545.2
See application file for complete search history.

(56) References Cited

U.S. PATENT DOCUMENTS 1,070,969 A 8/1913 Lee
1,241,484 A 9/1917 Butcher
(Continued)

FOREIGN PATENT DOCUMENTS

CA 2640744 A1 8/2006

OTHER PUBLICATIONS

"How to build a Tilt Alarm Circuit—Learning about Electronics", retrieved from the Internet <URL:http://web.archive.org/web/20140312154729/http://www.learningaboutelectronics.com/articles/Tilt-alarm-circuit.php>, http://www.learningaboutelectronics.com/articles/Tilt-alarm-circuit.php [retrieved on Mar. 12, 2014 (Dec. 3, 2014), pp. 1-6.
(Continued)

*Primary Examiner* — Kerri McNally
(74) *Attorney, Agent, or Firm* — Husch Blackwell LLP

(57) ABSTRACT

An alarm for a door is operable to generate an alarm signal when a rotary grip member of the door is rotated to a particular position, such as an unlocked position. The alarm comprises a housing having a strap retainer configured to receive and retain a strap to hold the housing to the rotary grip member. The alarm comprises a tilt switch for switching when the housing is tilted. Control circuitry is interconnected to the tilt switch and to an annunciator and is operable to activate the annunciator dependent on a state of the tilt switch.

16 Claims, 16 Drawing Sheets

(51) Int. Cl.

| | |
|---|---|
| ***G08B 25/08*** | (2006.01) |
| ***E05B 13/00*** | (2006.01) |
| *E05B 45/06* | (2006.01) |
| *G08B 3/10* | (2006.01) |
| *G08B 5/22* | (2006.01) |
| *G08B 5/36* | (2006.01) |

(56) References Cited

U.S. PATENT DOCUMENTS

| | | | | | |
|---|---|---|---|---|---|
| 1,251,864 | A | | 1/1918 | Cody | |
| 1,310,941 | A | | 7/1919 | Butcher | |
| 1,327,021 | A | | 1/1920 | Butcher | |
| 1,389,178 | A | | 8/1921 | Bacon | |
| 1,464,050 | A | | 8/1923 | Shimp | |
| 1,471,843 | A | | 10/1923 | Graef | |
| 1,522,419 | A | | 1/1925 | Coyne | |
| 1,675,878 | A | | 7/1928 | Cody | |
| 1,968,648 | A | | 7/1934 | Kendall | |
| 2,047,861 | A | | 7/1936 | Downing | |
| 2,997,609 | A | | 8/1961 | Lung | |
| 3,327,300 | A | * | 6/1967 | Birrenkott | G08B 13/08 200/61.62 |
| 3,725,892 | A | | 4/1973 | Faltico | |
| 4,086,457 | A | | 4/1978 | Niedermeyer | |
| 4,100,539 | A | * | 7/1978 | Stahl | G08B 13/02 200/61.45 R |
| 4,462,023 | A | | 7/1984 | Nielsen et al. | |
| 4,851,814 | A | * | 7/1989 | Rehberg | G08B 13/08 340/546 |
| 4,941,424 | A | * | 7/1990 | Hanft | G08B 13/08 116/155 |
| 5,293,990 | A | | 3/1994 | Masakayan | |
| 5,311,168 | A | | 5/1994 | Pease, Jr. et al. | |
| 5,734,324 | A | * | 3/1998 | James | E05B 45/06 340/546 |
| 5,767,467 | A | | 6/1998 | Grant | |
| 5,877,686 | A | | 3/1999 | Ibey et al. | |
| 5,955,713 | A | | 9/1999 | Titus et al. | |
| 6,356,203 | B1 | | 3/2002 | Halleck et al. | |
| 6,392,556 | B2 | | 5/2002 | Tomich | |
| 6,543,147 | B2 | | 4/2003 | Akieda | |
| 6,600,422 | B2 | | 7/2003 | Barry et al. | |
| 6,963,280 | B2 | | 11/2005 | Eskildsen | |
| 6,989,746 | B2 | | 1/2006 | Rasmussen | |
| 7,261,484 | B2 | | 8/2007 | Gallagher | |
| 7,450,025 | B2 | | 11/2008 | Fong | |
| 7,506,796 | B1 | | 3/2009 | Hanna | |
| 7,752,763 | B2 | | 7/2010 | Yamamoto | |
| 7,880,598 | B2 | | 2/2011 | Ciccaglione et al. | |
| 7,944,369 | B2 | | 5/2011 | Appleyard et al. | |
| 2001/0048372 | A1 | | 12/2001 | Tomich | |
| 2004/0061620 | A1 | | 4/2004 | Devine | |
| 2010/0033329 | A1 | | 2/2010 | Davis et al. | |
| 2010/0223582 | A1 | | 9/2010 | Dods | |
| 2011/0254689 | A1 | * | 10/2011 | Snyder | G08B 13/08 340/545.5 |

OTHER PUBLICATIONS

Safelincs Ltd., "Fire Exit Door Security Seal", Retrieved from the Internet <URL:http://web.archive.org/web/2008121111472/http://www.safelincs.co.uk/Fire-Exit-Door-Security-Seal/>; http://www.safelincs.co.uk/Fire-Exit-Door-Security-Seal/ [retrieved on Nov. 16, 2011 (Nov. 16, 2011), pp. 1-2.

International Search report with Written Opinion dated Jul. 13, 2015.

* cited by examiner

DOOR ALARM

CROSS REFERENCE TO RELATED APPLICATION

This application is a U.S. National Phase Application of International Application No. PCT/CA2015/050307 filed on Apr. 15, 2015, which claims the benefit of priority from U.S. Provisional Application 61/980,082 filed on Apr. 16, 2014. The disclosures of International Application No. PCT/CA2015/050307 and U.S. Provisional Application 61/980,082 are incorporated herein by reference.

FIELD

The present invention relates to alarms, and in particular, to alarms for rotary door hardware, such as for the thumb turns of door locks.

BACKGROUND

Various types of alarms exist to protect against unauthorized or undetected access to secured premises. Some such alarms may be installed on a knob of a door. Typically, such alarms include a switching mechanism to activate an auditory alarm signal when the door is opened. Unfortunately, conventional alarms may be difficult to install, only work in a single orientation, or provide limited information to the user.

SUMMARY

In an aspect, an alarm for a door having a rotary grip member is disclosed, comprising a housing having a strap retainer configured to receive a strap; a tilt switch supported by the housing for switching when the housing is tilted; an annunciator; control circuitry interconnected with the tilt switch to receive an input signal from the tilt switch, the control circuitry operable to activate the annunciator dependent upon a state of the tilt switch; a strap for retention by the strap retainer to strap the housing to the rotary grip member so that the housing rotates with the rotary grip member.

In another aspect, an alarm for a door having a rotary grip member is disclosed, comprising a housing having a strap retainer configured to receive a strap; a tilt switch supported by the housing for switching when the housing is tilted; an annunciator; control circuitry interconnected with the tilt switch to receive an input signal from the tilt switch, the control circuitry operable to activate the annunciator dependent upon a state of the tilt switch; a strap extending around the rotary grip member and retained by the strap retainer, said strap holding the housing to the rotary grip member so that the housing rotates with the rotary grip member.

BRIEF DESCRIPTION OF THE DRAWINGS

In the figures, which illustrate example embodiments.

DETAILED DESCRIPTION

Figure 1:
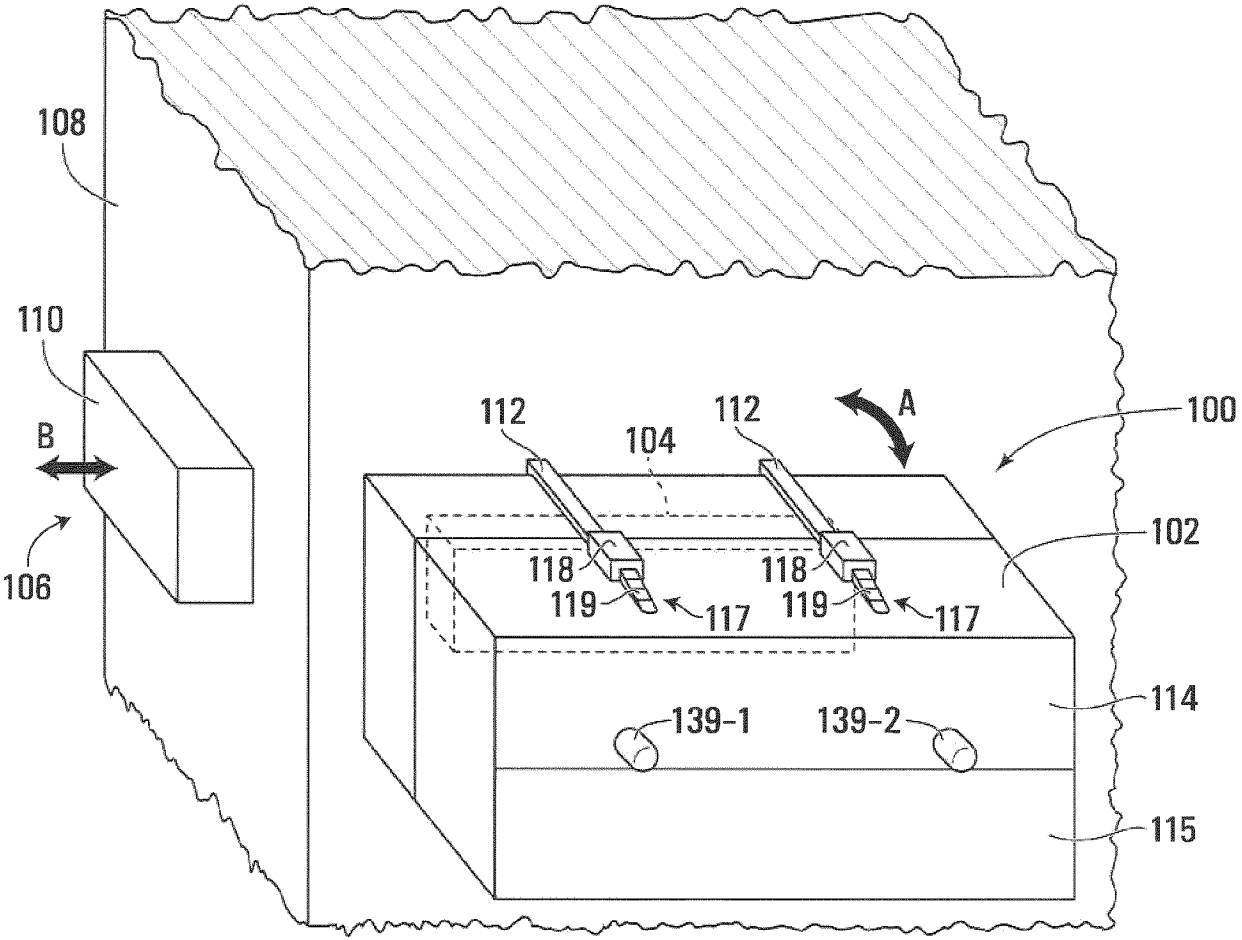
FIG. 1 is a perspective view of a door alarm installed on a door lock.

FIG. 1 depicts a door alarm 100. Door alarm 100 includes a housing 102, adapted for mounting to a rotary actuator of a door, e.g. a grip member such as thumb turn 104 of a door lock 106 in door 108.

Figure 2:
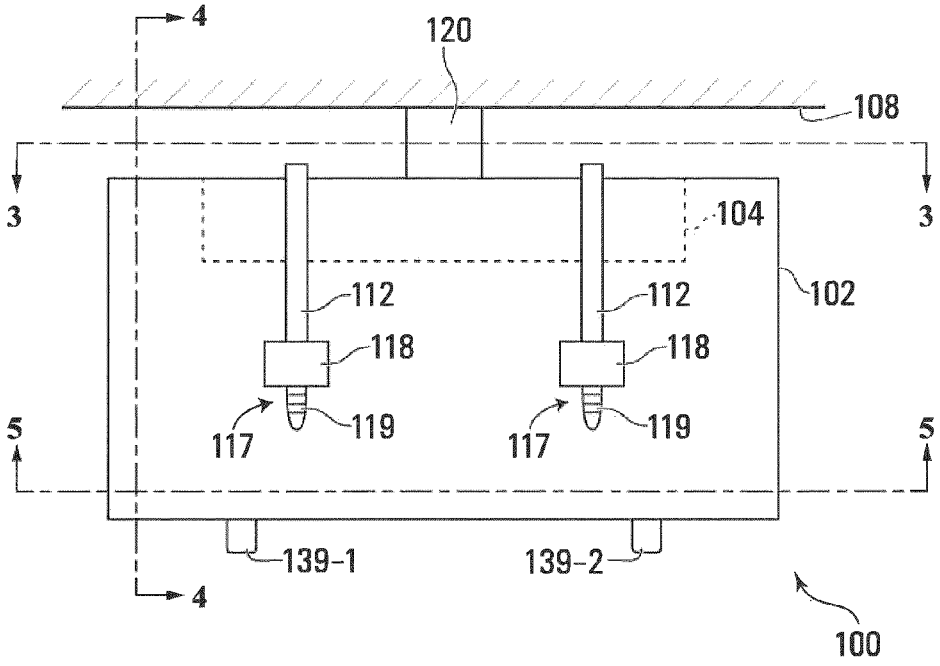
FIG. 2 is a top view of the door alarm of FIG. 1.

In conventional fashion, door lock 106 has a dead bolt 110, connected to thumb turn 104 such that rotation of thumb turn 104 in a vertical plane as indicated by arrow A causes dead bolt 110 to extend or retract from door 108 as indicated by arrow B. Thumb turn 104 has a locked position and an unlocked position. When thumb turn 104 is in its locked position, dead bolt 110 is extended. When thumb turn 104 is in its unlocked position, dead bolt 110 is retracted. As depicted in FIG. 2, in its locked position, thumb turn 104 is oriented substantially horizontally. In its unlocked position, thumb turn 104 is oriented substantially vertically. Thumb turn 104 extends from the surface of door 108 to allow manual operation by a user.

As will be appreciated, in other embodiments, housing 102 and thumb turn 104 may be oriented vertically in the locked position and horizontally in the unlocked position.

Figure 3:
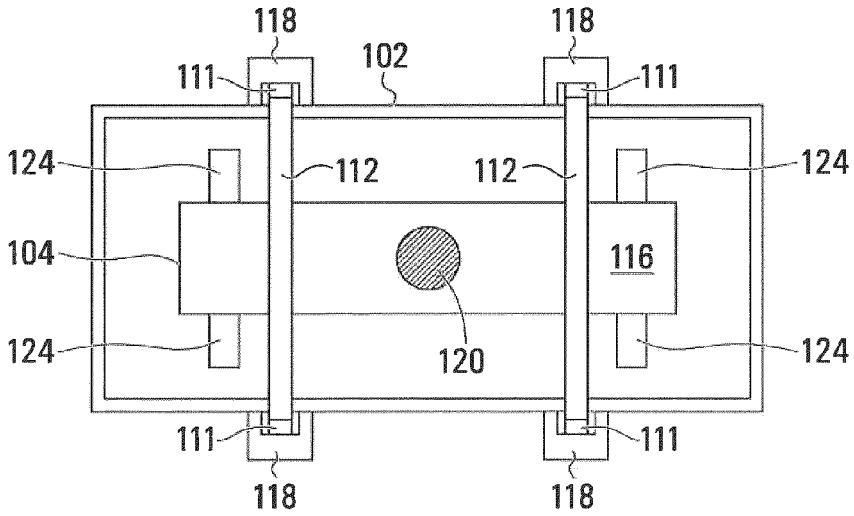
FIG. 3 is a rear cross-sectional view of the door alarm of FIG. 1, along line 3-3 shown in FIG. 2.

Referencing FIG. 3 along with FIG. 1, housing 102 of door alarm 100 is generally rectangular and has front, top and bottom and side walls. The rear of housing 102 is open so that door alarm 100 may be installed on door lock 106 by positioning housing 102 over thumb turn 104 so that thumb turn 104 is received in the rear of housing 102 and abuts four anchor posts 124 on housing 102. Anchor posts may be formed, for example, from metal plastic or wood and may be coated with a soft or tacky material such as rubber, silicone or the like, which may promote frictional engagement between thumb turn 104 and anchor posts 124. Housing 102 is securely held to thumb turn 104 by adjustable straps 112.

Strap retainers 118 are formed on housing 102 to hold straps 112 in place. In the depicted embodiment, housing 102 has two pairs of strap retainers 118, each pair comprising a strap retainer 118 on the top wall of housing 102 and a strap retainer on the bottom wall of housing 102. Each pair of strap retainers 118 holds a strap 112, with each end of the strap 112 being received in one strap retainer 118 of the pair. Each of strap retainers 118 has an internal pawl, indicated generally at 111. Straps 112 have ends 117 with teeth 119 which interlock with the pawls to define a ratchet mechanism between straps 112 and retainers 118 which allows the ends of straps 112 to be pulled through retainers 118 to tighten the straps 112, but prevents reversing (loosening of the straps). Straps 112 may therefore be tightened to pull against the strap retainers 118, urging housing 102 against thumb turn 104.

Tightening of straps 112 urges housing 102 against thumb turn 104 so that thumb turn 104 and anchor posts 124 bear against one another. Conveniently, strap retainers 118 prevent loosening or removal of straps 112 so that housing 102 cannot be removed from thumb turn 104 without breaking straps 112. Straps 112 may be formed of a tough nylon or plastic which can be cut with a blade, but with sufficient tensile strength so that a strap 112 cannot easily be broken by hand. Accordingly, once door alarm 100 is installed and secured with straps 112, it cannot easily be removed without a strap cutting tool.

It will be appreciated that a user may carry several sets of straps to allow re-use of the door alarm on different doors when, for example, the user is travelling.

As seen in FIG. 2, thumb turn 104 is formed at the end of a shaft 120 which extends into door 108 to operate the mechanism of lock 106 when thumb turn 104 is turned by a user. A small gap exists between door 108 and the rear surface 116 (FIG. 3) of thumb turn 104, which accommodates straps 112. As depicted, straps 112 hold housing 102 against thumb turn 104 so that the rear edge of housing 102 is approximately flush with rear surface 116 of thumb turn 104. However, as will become apparent, in other embodiments, thumb turn 104 may protrude from the rear edge of housing 102 or the rear edge of housing 102 may extend past thumb turn 104.

FIG. 3 depicts door alarm 100 and thumb turn 104 in rear cross-sectional view along lines 3-3 shown in FIG. 2. Housing 102 has an interior transverse wall 122, with four anchor posts 124 extending diagonally therefrom towards thumb turn 104.

Figure 4:
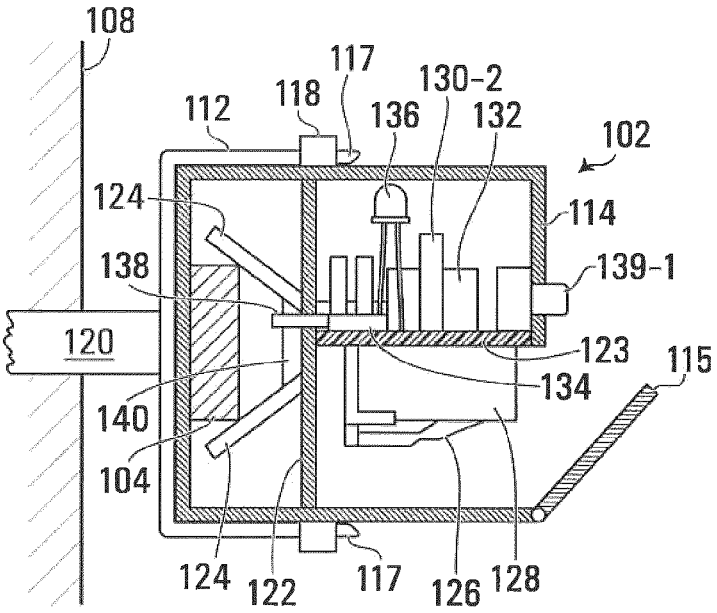
FIG. 4 is a cross-sectional view of the door alarm of FIG. 1, along the line 4-4 shown in FIG. 2.

As is best shown in FIG. 4, anchor posts 124 extend diagonally from wall 122 and define a notch into which thumb turn 104 is received. Straps 112 squeeze thumb turn 104 against anchor posts 124, securing engagement of door alarm lock 100 to thumb turn 104.

Figure 5:
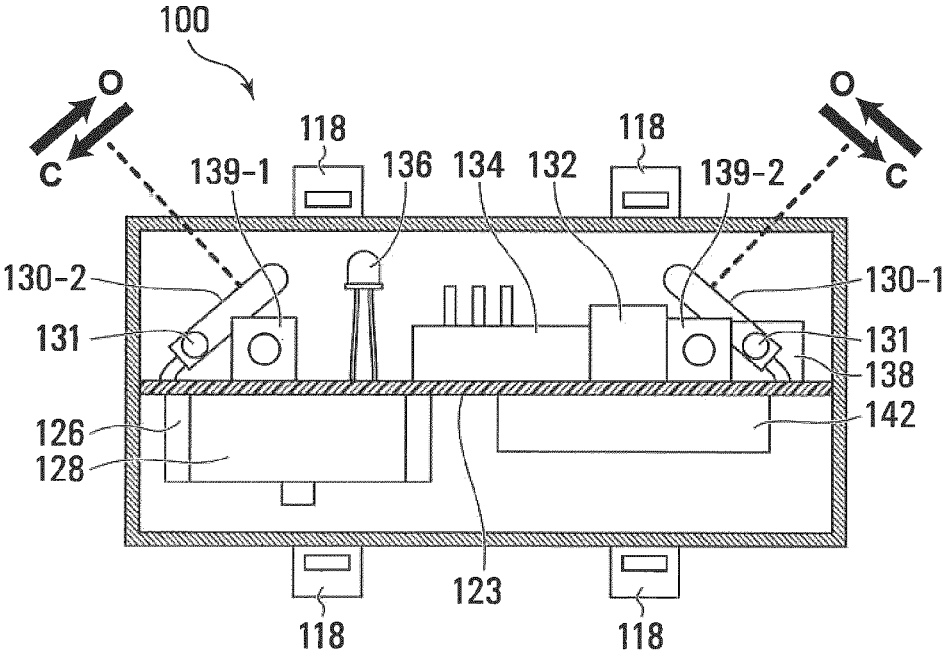
FIG. 5 is a cross-sectional view of the door alarm of FIG. 1, along the line 5-5 shown in FIG. 2, with the door alarm in a first orientation.

Referencing FIGS. 4 and 5, housing 102 of door alarm 100 also has a circuit board 123, extending from transverse wall 122 to a front wall 114 of housing 102. Mounted to circuit board 123 are a battery holder 126 holding a battery 128, two tilt switches 130-1 and 130-2 (individually and collectively, tilt switches 130), a control unit 134, and light and audio annunciators, namely, speaker 132 and light-emitting diode (LED) 136 and a wireless transceiver 142. As depicted, control unit 134 and wireless transceiver 142 are formed as separate chips. However, in some embodiments, control unit 134 and wireless transceiver 142 may be modules of a single chip. Door alarm 100 is also equipped with a power switch 138, mounted to circuit board 123.

Battery 128 may be any suitable type and size of battery, such as a 9V, C, D, AA, or AAA alkaline or lithium-ion cell or the like. Battery 128 may be single-use or rechargeable. In some embodiments, battery 128 may comprise multiple cells connected in series or parallel. Battery holder 126 is configured to securely hold battery 128 to circuit board 123 and thus, to housing 102 and electrically interconnect battery 128 to the alarm circuit. Front wall 114 of housing 102 has a hinged door portion 115 to allow access to battery holder 126 and battery 128. Battery 128 may be replaced by lifting door portion 115. In other embodiments, door 115 is removable, rather than being hinged.

Figure 6:
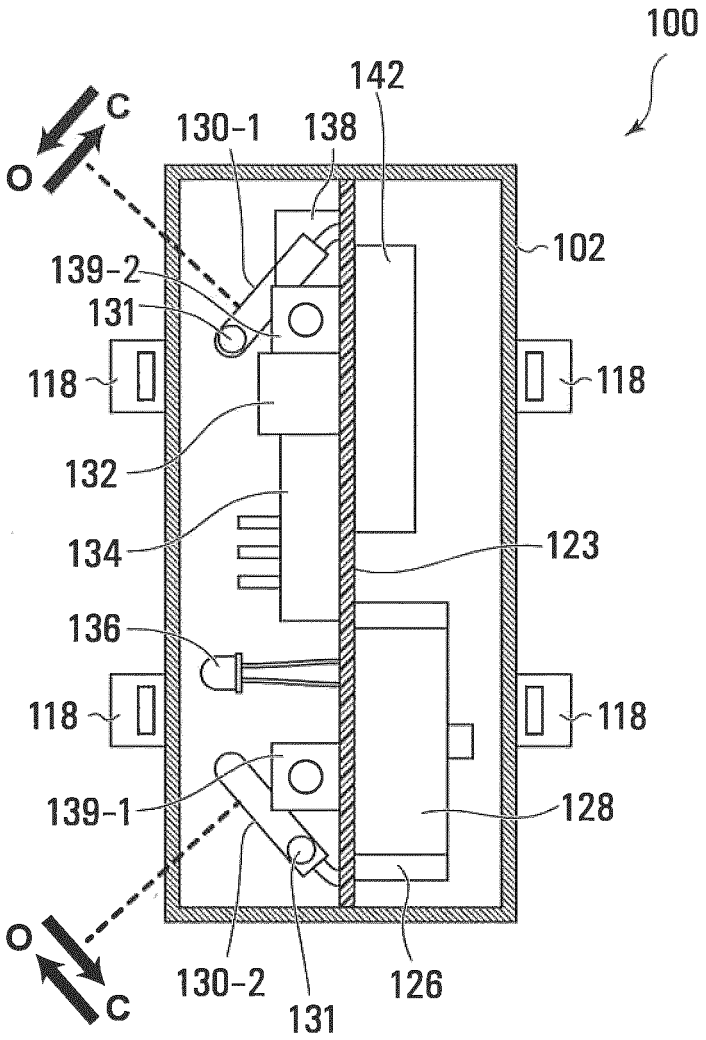
FIG. 6 is a further cross-sectional view of the door alarm of FIG. 1, along the line 5-5 shown in FIG. 2, with the door alarm in a second orientation.

Each of tilt switches 130-1, 130-2 has a set of electrical contacts and a movable element 131 which moves under the influence of gravity to close (turn ON) the switch in a first orientation and to open (turn OFF) the switch in a second orientation. When gravity pulls the movable element in the direction indicated by arrow O in FIG. 5, the switch is opened (turned OFF). Conversely, when gravity pulls the movable element in the direction of arrow C, the switch is closed (turned ON). Tilt switches 130-1, 130-2 extend at approximately a 90-degree angle to one another. With door alarm 100 installed, tilt switches 130-1, 130-2 are each oriented in a vertical plane parallel to the plane of rotation of thumb turn 104. In the position shown in FIGS. 1-5, thumb turn 104 is oriented substantially horizontally, and each of tilt switches 130-1 and 130-2 extends upwardly at an angle of approximately 45 degrees to the vertical. In this position, both tilt switches 130-1 and 130-2 are closed (turned ON). Conversely, when thumb turn 104 and housing 102 are rotated to a vertical orientation, one of tilt switches 130-1 and 130-2 extends downwardly at an angle of approximately 45 degrees to the vertical and is pulled open (turned OFF) by gravity. For example, as depicted in FIG. 6, housing 102 is rotated 90 degrees counter-clockwise relative to its position in FIG. 5, and tilt switch 130-1 is pulled open (turned OFF). If, alternatively, housing 102 were rotated 90 degrees clockwise from the position shown in FIG. 5, tilt switch 130-2 would be pulled open (turned OFF). If housing 102 were rotated 180 degrees from the position shown in FIG. 5, both of tilt switches 130-1, 130-2 would be pulled open (turned OFF). Thus, the states of tilt switches 130 are indicative of the position of housing 102 and thumb turn 104. When housing 102 and thumb turn 104 are oriented horizontally, both of tilt switches 130-1, 130-2 are in the same state (ON or OFF). When housing 102 and thumb turn 104 are oriented vertically, tilt switches 130-1, 130-2 are in different states (one ON, one OFF).

Speaker 132 is a conventional low-power speaker. Speaker 132 is sufficiently powerful to produce an audible alarm signal when powered. Speaker 132 may, for example, be adapted to emit a high-pitched tone or an oscillating siren signal when powered.

Transceiver 142 includes an antenna and appropriate control circuitry. Transceiver 142 is adapted to send and receive messages in one or more protocols and on one or more frequency bands. Transceiver 142 may include for example, GSM/GPRS/3G, WI-FI, RF, Bluetooth or similar radios.

Control unit 134 is an integrated circuit adapted to determine the state of tilt switches 130-1 and 130-2 and thus, the orientation of housing 102 and thumb turn 104 to which housing 102 is mounted. Control unit 134 includes a memory (not shown) with firmware installed thereon. The firmware provides logic functions for producing outputs of the door alarm by driving speaker 132, LED 136 and transceiver 142 based on the determined states of tilt switches.

Door alarm 100 also has mode selector buttons 139-1 and 139-2, which are operatively mounted to circuit board 123 and protrude through front wall 114. Mode selector buttons 139-1 and 139-2 are used to select a mode corresponding to the direction of rotation of housing 102 (clockwise or counter-clockwise) required to unlock lock 106.

Figure 7:
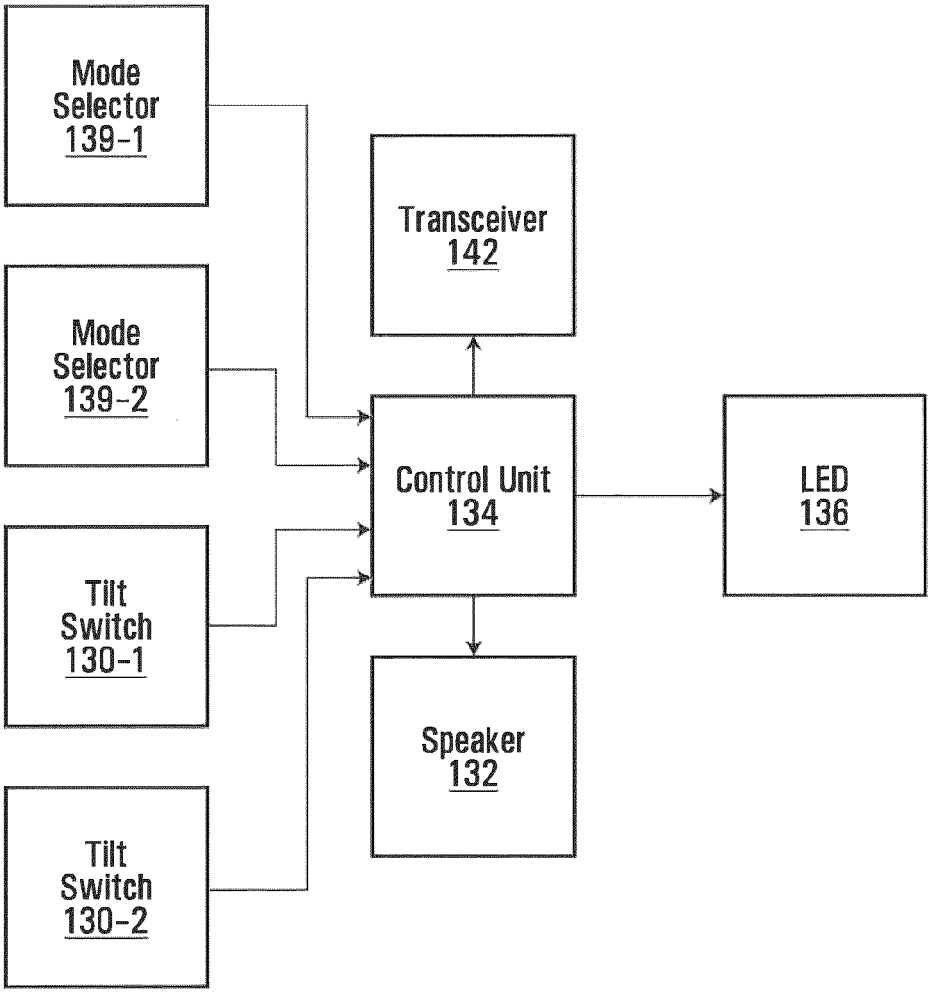
FIG. 7 is a schematic block diagram of components of the door alarm of FIG. 1.

FIG. 7 depicts a schematic block diagram of components of door alarm 100. Control unit 134 receives input signals indicative of the states of each of tilt switches 130-1 and 130-2 and mode selector buttons 139-1 and 139-2. In an example embodiment, each of tilt switches 130-1 and 130-2 and mode selector buttons 139-1 and 139-2 may be connected to a different digital input of control unit 134, with LOW and HIGH digital signals on these inputs indicating the respective states of each switch.

Based on these input signals, control unit 134 provides control signals to each of the annunciators (speaker 132 and LED 136) and to transceiver 142.

Control unit 134, speaker 132, LED 136 and transceiver 142 are powered by battery 128 (FIG. 6).

As noted, control unit 134 receives input signals indicating the states of each of tilt switches 130-1 and 130-2, and thus, the orientation of housing 102 and thumb turn 104. As is further described below, door alarm 100 is armed by powering on door alarm 100, installing door alarm 100 on thumb turn 104, turning thumb turn 104 to its locked position, and actuating one of mode selector buttons 139-1, 139-2 to indicate to control unit 134 the states of tilt switches 130-1, 130-2 when thumb turn is in each of its locked and unlocked positions.

As will be appreciated, the states of tilt switches 130-1, 130-2 change as door alarm 100 is rotated in approximately 90-degree increments. Firmware of control unit 134 stores a sequence of states representing a progression of rotations in each direction. That is, when door alarm 100 is in a particular orientation, firmware in control unit 134 is able to determine the next state in a first direction (e.g., clockwise) and the next state in a second direction (e.g. counter-clockwise), which corresponds to the previous state in the first direction.

Firmware of control unit 134 maintains a count of the number of times housing 102 and thumb turn 104 are moved to the unlocked position. Control unit 134 includes a reset trigger, to reset the count. For example, the count maintained by of control unit 134 may be reset when mode selector buttons 139-1 and 139-2 are toggled in a certain pattern. Additionally or alternatively, the counting circuitry may be reset when power is removed, i.e. when battery 128 is removed from holder 126.

Control unit 134 controls each of speaker 132, LED 136 and transceiver 142 based on whether housing 102 and thumb turn 104 are in a locked or unlocked position and based on the count maintained in control unit 134.

In addition, control unit 134 may cause one or more of speaker 132, LED 136 and transceiver 142 to emit a low battery warning signal when battery 128 is depleted to below a threshold level.

In use, door portion 115 of front wall 114 is opened and battery 128 is installed in battery holder 126. Door alarm 100 is powered on by actuating power switch 138, accessed through the rear face of housing 102.

Door alarm 100 is installed on thumb turn 104 by positioning housing 102 over thumb turn 104, with thumb turn 104 received in the rear of housing 102. Straps 112 are looped around thumb turn 104 and ends 117 are received by strap retainers 118 of housing 102 and tightened. Straps 112 pull anchor posts 124 into snug engagement with thumb turn 104, securing housing 102 to thumb turn 104. Once door alarm 100 is installed on thumb turn 104, power switch 138 cannot be accessed. Accordingly, door alarm 100 cannot be turned off without removing door alarm 100 from thumb turn 104.

Door alarm 100 is installed so that it is upright, with door portion 115 at the bottom of front wall 114, when thumb turn 104 is in its horizontal, locked orientation. In this position, both tilt switches 130 are (ON).

Mode selector buttons 139-1, 139-2 are used to indicate to control unit 134 the direction in which thumb turn 104 rotates to unlock. Thus, mode selector buttons 139-1, 139-2 indicate to control unit 134 the states of tilt switches 130-1, 130-2 when thumb turn 104 is in its unlocked orientation.

To set the mode of door alarm 100, door alarm 100 is powered on, installed on thumb turn 104, and oriented in its locked position. One of mode selector buttons 139-1, 139-2 is pressed to indicate the direction in which thumb turn 104 rotates to reach the unlocked position. Control unit 104 reads the states of tilt switches 130-1, 130-2 and recognizes those states as being indicative of the locked position. Thus, the operation of mode selector buttons 139 and power switch 138 identify the locked state. One of mode selector buttons 139-1, 139-2 is pressed to indicate the direction in which thumb turn 104 rotates to reach the unlocked position. For example, mode selector switch 139-1 may be pressed to indicate a counter-clockwise turn to the unlocked position, or mode selector switch 139-2 may be pressed to indicate a clockwise turn to the unlocked position. Based on the measured state of tilt switches 130-1, 130-2 in the locked position and the selected direction of turning to the unlocked position, by reference to the sequence of states loaded in firmware, control unit 134 determines and stores the states of tilt switches 130-1, 130-2 which are indicative of unlocking.

As noted, in the depicted embodiment, the locked position is as shown in FIG. 5, and the unlocked position is as shown in FIG. 6 (a counter-clockwise turn). Thus, to arm door alarm 100, the alarm would be powered on, and the alarm installed and oriented in the position of FIG. 5. Mode selector button 139-1 would then be pressed, causing control unit 134 to store the states of tilt switches 130-1, 130-2, namely, both ON, as indicative of the locked position. Pressing of mode selector button 139-1 indicates to control unit 134 that the next orientation in the counter-clockwise direction (i.e. with tilt switch 130-1 OFF and tilt switch 130-2 ON) is indicative of unlocking and also causes control unit 134 to store the states of the switches in that orientation as being indicative of the unlocked position.

Once armed, control unit 134 continuously monitors for signals received from tilt switches 130-1, 130-2. If thumb turn 104 and housing 102 are rotated counter-clockwise from the position shown in FIG. 5 to the unlocked position of FIG. 6, tilt switch 130-1 will turn OFF, and tilt switch 130-2 will remain ON, indicating to control system 134 that door lock 106 is unlocked.

When control unit 134 determines that thumb turn 104 is in its unlocked position, counting firmware in control unit 134 increments a count of the number of times door lock 106 has been unlocked. The count is maintained until door lock 100 is reset. In an embodiment, the count may be reset when door lock 100 is powered off using power switch 138. In another embodiment, the count may be reset when battery 128 is removed from holder 126. The count may also be reset when it exceeds a predetermined value.

When the control unit 134 senses the door is unlocked, the, control unit 134 activates speaker 132 and LED 136. Speaker 132 may emit an alarm signal, such as a loud constant tone, siren, or recorded message and LED 136 may be illuminated.

The alarm signal generated by speaker 132 and illumination of LED 136 may alert the user of door alarm 100 or other nearby persons of tampering or unauthorized unlocking of door lock 106. Moreover, if the alarm signal is caused by an intruder unlocking door lock 106, the loud alarm signal may draw attention and deter the intruder from passing through door 108. If the door is unlocked by the user, the alarm signal and illuminated LED may provide a reminder to the user to re-lock door lock 106.

Control unit 134 may also cause transceiver 142 to transmit an alert message. In an embodiment, the alert message may be a message sent over a cellular network. For example, the alert message may be an SMS message sent to the cellular phone of the owner of door alarm 100, warning that door 108 has been unlocked. Thus, the user may be alerted by a message sent to a cellular phone, of possible intrusion or tampering with door lock 106 when not in close proximity to door alarm 100. In other embodiments, transceiver 142 may transmit a message to a dedicated receiver which may be portable and carried by the user of door alarm 100. In still other embodiments, transceiver 142 may transmit a message to a central monitoring station.

After door alarm 100 is triggered, that is, after control unit 134 senses that the door is unlocked, control unit 134 continues to activate speaker 132, even if door alarm 100 is returned to the locked position. Control unit 134 may be caused to deactivate speaker 132 by actuating mode selector buttons 139-1, 139-2 in a predetermined disarming sequence. The disarming sequence may be pre-set in the firmware of control unit 134, or may be manually set by invoking a programming mode of control unit 134 (such as by actuating mode selector buttons 139-1, 139-2 in a sequence) and then entering a desired disarming sequence.

Control unit 134 may also be programmed to deactivate speaker 132 when a predetermined time has elapsed after activation.

The operation of speaker 132, LED 136 and transceiver 142 may also be controlled to indicate to the user the number of times that thumb turn 104 has been moved to its unlocked position. This may inform the user of tampering or unauthorized access, even if the user does not hear the alarm signal, see the illuminated LED 136 or receive a message from transceiver 142 when such tampering or unauthorized access occurs.

Thus, when thumb turn 104 is in its locked position such that the alarm is not in alarm mode, speaker 132 and LED 136 could be operated in intermittent or oscillating patterns indicative of the unlock count. Thus, one or both of speaker 132 and LED 136 may be operated in a series of short pulses equal to the unlock count. For example, it may be that when the thumb turn 104 is in the locked position, the control unit 134 may control LED 136 to blink twice at periodic intervals to indicate the door has been unlocked twice since the last reset.

Conveniently, this may enable a user to determine if tampering or unauthorized unlocking of lock 106 has occurred, even if the user does not hear or receive an alarm signal. If lock 106 is expected to be unlocked a certain number of times, the lock count may advise the user of any locking over and above that number. For instance, if door alarm 100 is used on a hotel room lock, a user may expect the lock to be opened once per day for housekeeping. If speaker 132 or LED 136 indicate that the lock has been opened more than once, a user will know that at least one unlocking was unauthorized or unexpected.

In other embodiments, control unit 134 may activate speaker 132 when door alarm 100 is moved to any orientation other than the locked orientation. In one such embodiment, mode selector buttons 139-1, 139-2 may be replaced with a single button which, when pressed to arm door alarm 100, causes firmware of control unit 134 to store the states of tilt switches 130-1, 130-2 and thereafter continually monitor the states of tilt switches 130-1, 130-2. As will be apparent, any change in state of either of tilt switches 130-1, 130-2 indicates a change in orientation of door alarm 100 and control unit 134 may therefore activate speaker 132 whenever either one of tilt switches 130-1, 130-2 changes from its respective stored state.

Though the above-described example relates to a thumb turn 104 which is in a horizontal orientation when locked and which rotates counter-clockwise to a vertical orientation when unlocked, those of ordinary skill will appreciate that door alarm 100 could also be used with a thumb turn which is oriented vertically when locked and/or with a thumb turn with rotates clockwise to unlock.

Moreover, door alarm 100 may be used with thumb turns which are oriented obliquely in the locked and unlocked positions and which rotate through approximately 90 degrees to transition between locked and unlocked states. In such embodiments, door alarm 100 would be installed on the thumb turn and armed with the thumb turn in the locked position, and mode selector buttons 139-1, 139-2 would be used to select the appropriate direction in which the thumb turn rotates to unlock. As will be appreciated, the range of oblique angles in which door alarm 100 will function may be limited by the minimum operational orientations of tilt switches 130-1, 130-2. In some embodiments, tilt switches 130-1, 130-2 may have a minimum operational angle of 15 degrees. That is, tilt switches 130-1, 130-2 may change states only if inclined by 15 degrees or more from the horizontal. In such embodiments, door alarm 100 may be used in oblique orientations such that, in both the locked and unlocked states, tilt switches are inclined by at least 15 degrees from horizontal.

Conveniently, door alarm 100 may be easily installed on substantially any rotary grip member (e.g. thumb turn or handle) of any door. Installation may be permanent or temporary, as door alarm 100 may be removed by cutting straps 112. Moreover, anchor posts 124 and straps 112 allow door alarm 100 to be installed on a wide range of locks, provided the handle is small enough to be received in housing 102 and large enough to be snugly engaged between straps 112 and anchor posts 124. Anchor posts 124 may be resiliently deformable so that they may deflect slightly to accommodate a wider range of shapes and sizes of door grips. Door alarm 100 may therefore be used as a portable alarm. For example, lock alarm may be used as a temporary, portable alarm on the door lock of a hotel room.

As described above, door alarm 100 is installed on a thumb turn of a door lock and provides an alarm when the lock is opened (unlocked). However, in other embodiments, door alarm 100 may be installed on other types of rotary hardware of doors. For example, door alarm 100 may be installed on a door handle or door knob and may detect whether the position of the handle or knob is consistent with the door's latch being open or closed. Accordingly, a user may be provided with an alarm indicating that a door has been opened and counting the number of times the door has been opened, regardless of whether the door itself is equipped with a lock.

As described above, tilt switches 130-1, 130-2 are oriented at approximately a 45 degree angle to the vertical and approximately a 90 degree angle to one another. In this orientation, tilt switches are effective for detecting movement of thumb turn 104 between horizontal and vertical positions. In other embodiments, tilt switches may be arranged in different orientations so that they switch at different orientations of the housing. The arrangement of tilt switches may be based on the range of motion of the handle to which an alarm is installed. For example, if a thumb turn rotates through more or less than 90 degrees during opening/unlocking, the tilt switches may be re-oriented appropriately so they are OFF in one of the open or closed position and ON in the other of the open or closed position. In addition, more or fewer than two tilt switches may be used in any number of unique orientations so that the combined state of the tilt switches indicates whether the thumb turn is in an open or closed position.

Figure 8:
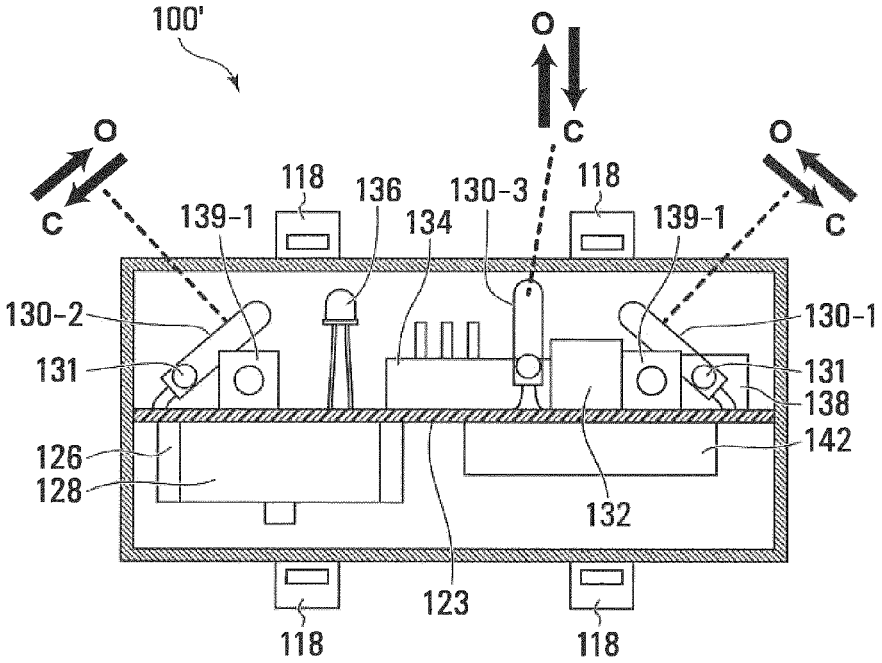
FIG. 8 is a cross-sectional view of another door alarm in a first orientation.
Figure 9:
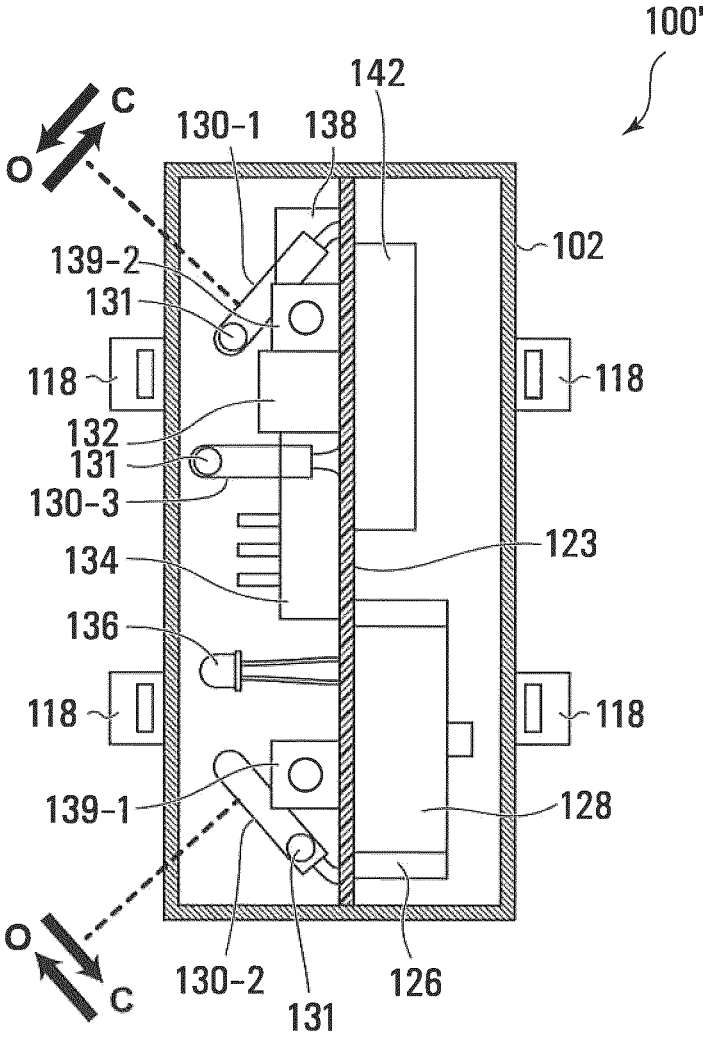
FIG. 9 is a cross-sectional view of the door alarm of FIG. 8 in a second orientation

FIGS. 8-9 depict a door alarm 100' with three tilt switches 130-1, 130-2 and 130-3. Like parts of door alarm 100' to those of door alarm 100 have been designated with like reference numerals. Third tilt switch 130-3 is oriented approximately at a 45 degree angle with each of tilt switches 130-1, 130-2. Since tilt switches 130-1, 130-2 and 130-3 are oriented at different angles, each one will change between its respective ON (closed) and OFF (open) states at a different angular position of door alarm 100'. Specifically, since tilt switches 130-1, 130-2, 130-3 are oriented at approximately 45 degree angles to one another, one of tilt switches 130-1, 130-2 and 130-3 will change its ON or OFF state with each rotation of door alarm 100' through approximately 45 degrees. Thus, control unit 134 of door alarm 100' may be capable of detecting up to eight different orientations of door alarm 100', separated by approximately 45 degree angles and door alarm 100' may therefore be suitable for use with a thumb turn that only rotates through 45 degrees to open. In other embodiments, more tilt switches may be added at different angular orientations to enable defection of a greater number of discrete angular orientations of a door alarm, at smaller angular intervals.

In some embodiments, straps 112 may be adjustable other than by forming a ratchet mechanism with retainers 118. For example, straps 112 may be provided with clasps which may be attached to straps 112 after straps 112 are received through retainers 118 to prevent the straps 112 from slipping out of the retainers 118. The position of such clasps may be adjustable and may define the effective length of straps 112. Alternatively, straps may be received through retainers 118 and knotted to prevent slipping out of the retainers.

Figure 10:
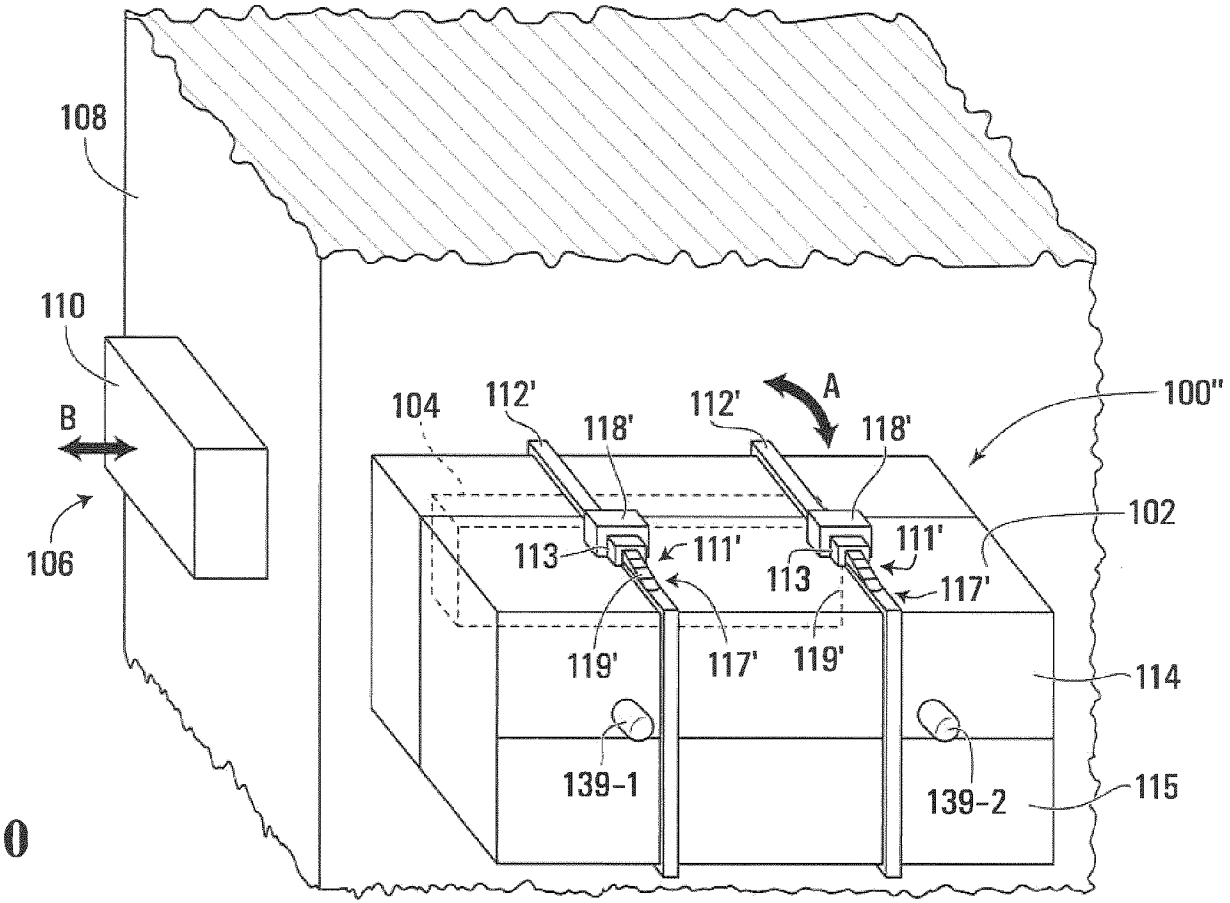
FIG. 10 is a perspective view of another door alarm installed on a door lock.

In some embodiments, straps may have an integrally-formed head at one end. FIG. 8 illustrates one such embodiment, where like parts to parts of door alarm 100 (FIG. 1) have been given like reference numerals. As illustrated in FIG. 10, a door alarm 100" is installed using straps 112' with heads 113. Door alarm 100" has strap retainers 118' which differ from strap retainers 118. Each head 113 is adapted to receive the opposite end 117' of the respective strap 112' and has an internal pawl indicated generally at 111' which forms a ratchet mechanism with teeth 119' on the other end 117' of the respective strap 112'. Straps 112' are received in strap retainers 118'. Strap retainers 118' are eyelets with central apertures sized so that a free end of a strap 112' can be passed therethrough. To install door alarm 100" to a thumb turn or other rotary grip member of a door, the alarm is positioned over the rotary grip member, and then each of straps 112' is installed by threading a free end through a first strap retainer 118', then around the rotary grip member, around housing 102 and into head 113. The strap is then tightened by pulling its end through head 113. The retainers 118', in combination with the head 113, hold the strap 112' in place.

Figure 11:
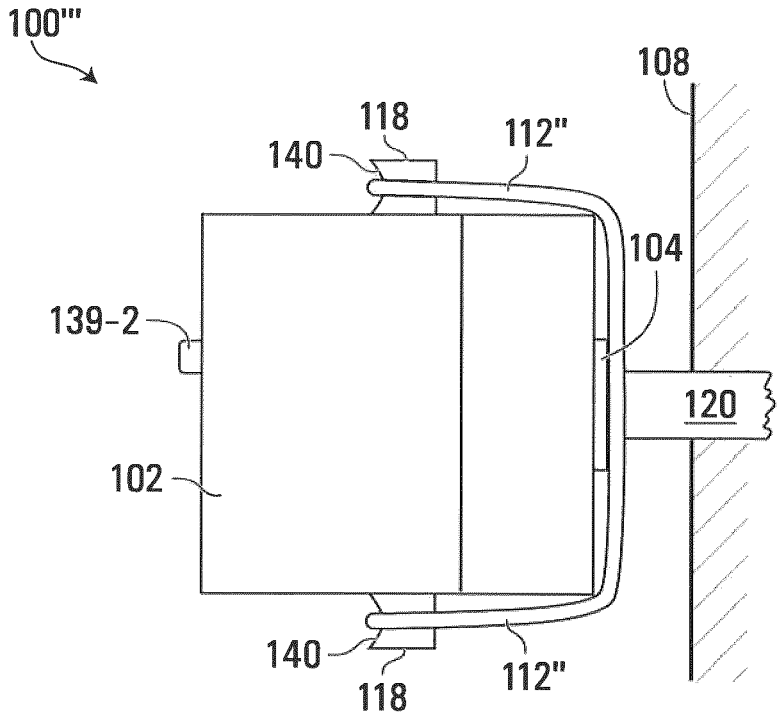
FIG. 11 is a side view of another door alarm installed on a door lock.
Figure 12:
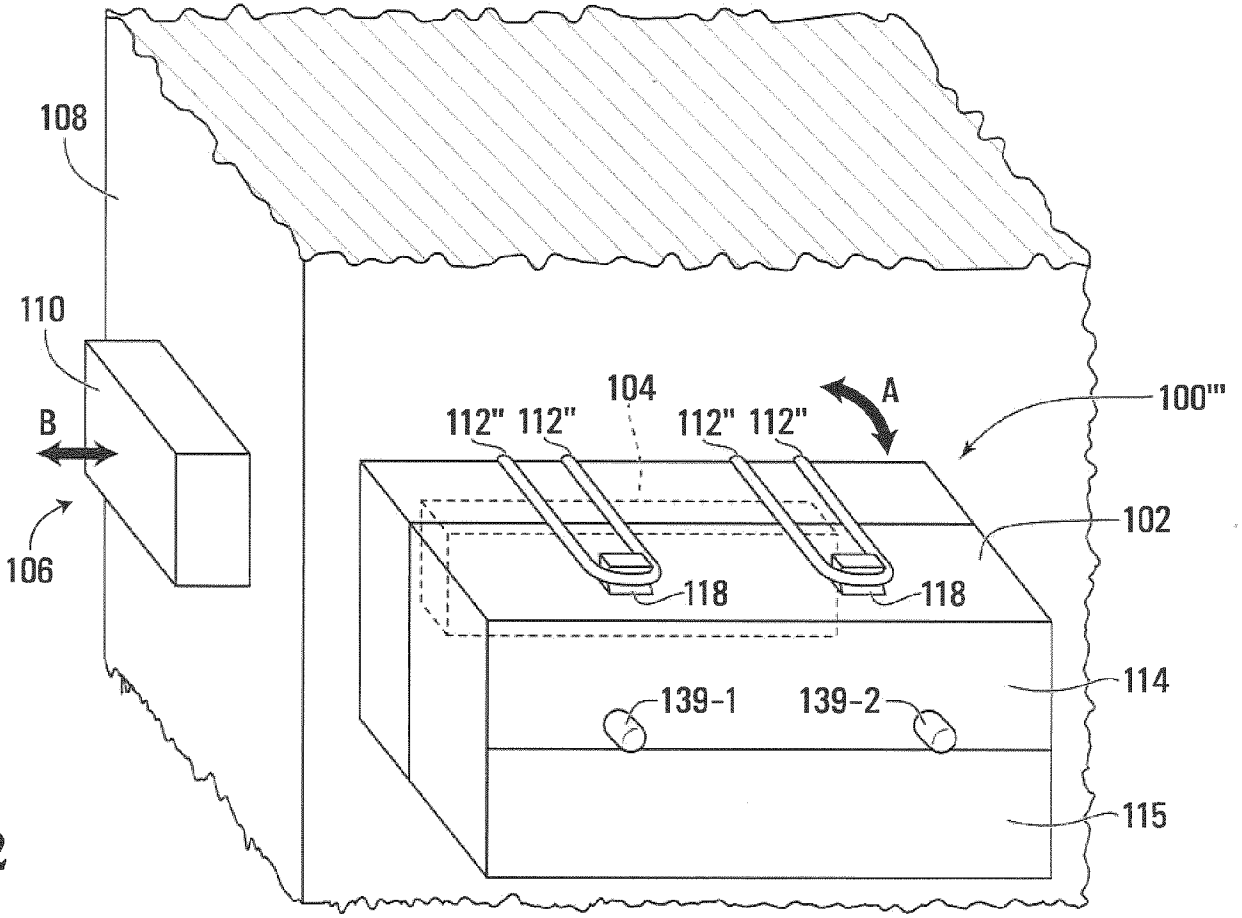
FIG. 12 is a perspective view of the door alarm of FIG. 11.

In some embodiments, straps may be elasticized loops. FIGS. 11-12 illustrate one such embodiment, where like parts to parts of door alarm 100 have been given like reference numerals. As illustrated in FIGS. 11-12, a door alarm 100'" is installed by looping bands 112" around thumb turn 104 and strap retainers 118". Strap retainers 118" are formed as hooks, with notches 140 opening away from thumb turn 104 to receive and securely hold bands 112".

Figure 13:
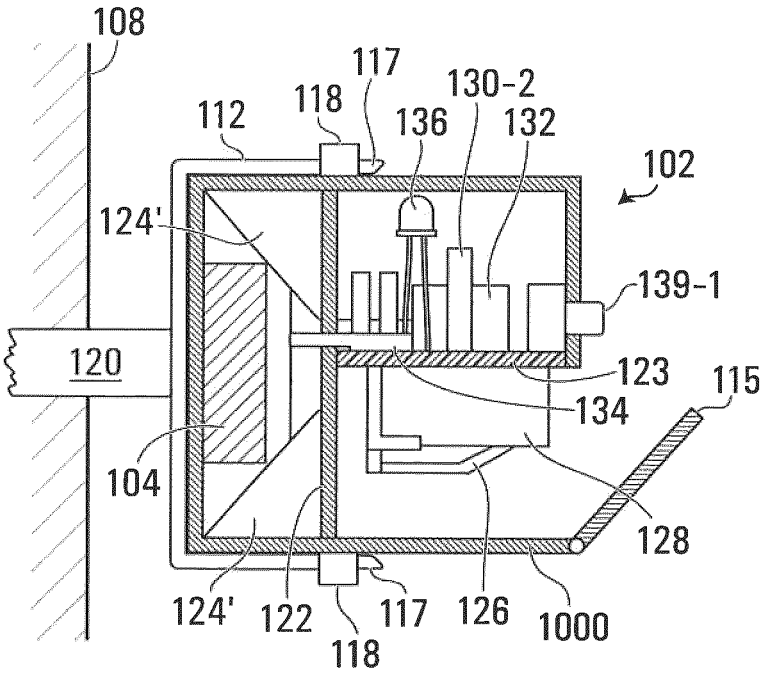
FIG. 13 is a cross-sectional view of another door alarm.

In some embodiments, posts 124 may be replaced with walls defining a notch into which thumb turn 104 may be received. For example, FIG. 13 depicts a door alarm 1000, identical to door alarm 100, except that anchor posts 124 have been replaced with anchor walls 124' which extend from the outer walls of housing 102 and from internal wall 122 to define a rearward-facing notch to receive thumb turn 104. Posts 124 or walls 124' may be constructed of any material and attached to housing 102 in any manner that provides sufficient rigidity to securely brace against thumb turn 104. As will be appreciated, walls 124' may tend to be more rigid than posts 124 of the same material and attached in the same manner.

Figure 14:
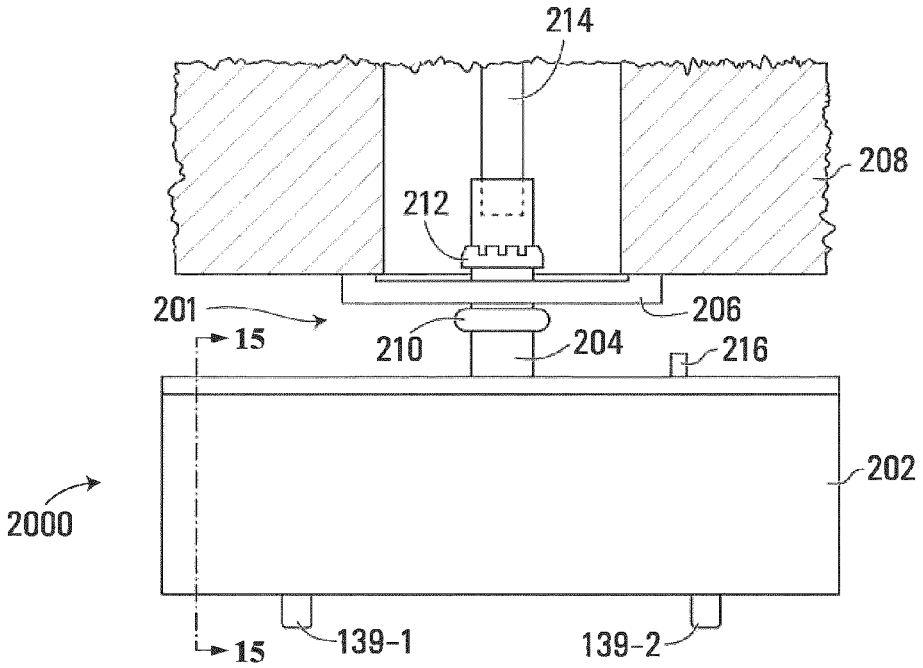
FIG. 14 is a top view of another door alarm.
Figure 15:
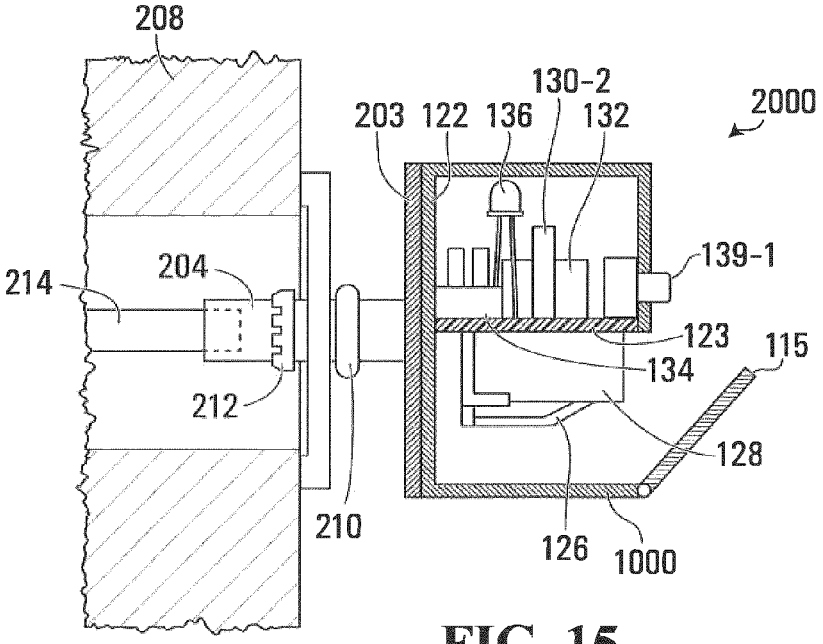
FIG. 15 is a cross-sectional view of the door alarm of FIG. 14 along line 15-15.

In some embodiments, door alarms may be formed integrally with a rotary hardware of a door, so that the grip of the rotary hardware forms the housing of the alarm. For example, FIGS. 14-15 depict one such door alarm 2000. Many components of door alarm 2000 are identical to those of door alarm 100 and are indicated with like numerals. For example, door alarm 2000 comprises a control unit 134 connected to switches 130-1, 130-2, mode selectors 139-1, 139-2, transceiver 142, LED 136 and speaker 132. Door alarm 2000 further comprises a battery 128 in a battery holder 126, accessible through a door 215 in housing 202. A power switch 216 (FIG. 14) is positioned at the rear of housing 202.

Door alarm 2000 acts as the thumb turn of a door lock 201. Housing 202 of door alarm 2000 has a back plate 203 removably attached to transverse wall 122, for example, using clips (not shown). A shaft 204 extends from back plate 203 and is retained on door 208 with a plate 206. Shaft 204 may be fixed to back plate 203 or formed integrally with back plate 203. Shaft 204 is held in door lock 201 by a plate 206, a collar 210 positioned on shaft 204 outside the door 208 and a lock washer 212 positioned on shaft 204 in the interior of door 208. Shaft 204 receives a lock shaft 214 which is connected to a deadbolt (not shown) and rotates to actuate the lock. Lock 201 may be operated by turning housing 202. That is, the deadbolt may be extended when housing 202 is turned to a locked position and retracted when housing 202 is turned to an unlocked position.

Door alarm 2000 may be operated in substantially the same manner as door alarm 100. That is, door alarm 2000 may be armed, and the unlocked orientation selected, in substantially the same manner. Control unit 134 then operates as described above in connection with FIGS. 5-7.

Door alarm 2000 may be provided as part of a custom lock 201. Alternatively, housing 202 and its internal components may be provided along with shaft 204 for retrofitting to an existing lock. For example, plate 206 of a lock may be removed and shaft 204 may be mounted to lock shaft 214 of an existing lock. Shaft 204 may therefore be configured to be mountable to multiple possible types of lock shaft 214 so as to be compatible with multiple kinds (e.g. brands) of locks.

In some embodiments, shaft 204 may be formed integrally with or attached directly to transverse wall 122 of housing 202.

As depicted above in FIGS. 1-4, anchor posts 124 of door alarm 100 are connected directly to transverse wall 122 of housing 102. In some other embodiments, anchor posts may be attached using a removable back plate. Moreover, as depicted in FIGS. 1-4, strap retainers are formed on the walls of housing 102. In other embodiments, strap retainers may be formed on the anchor posts.

Figure 16:
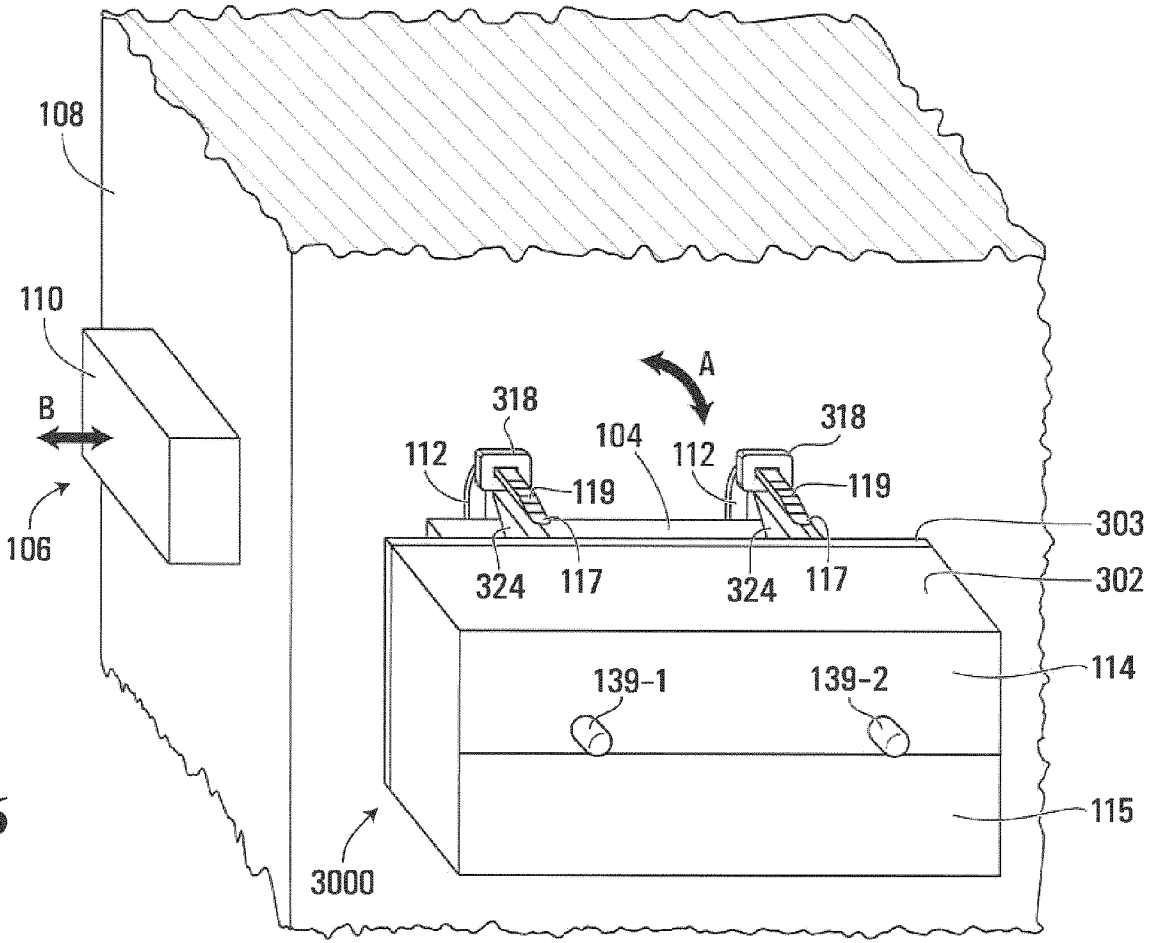
FIG. 16 is a perspective view of another door alarm installed on a door lock.
Figure 17:
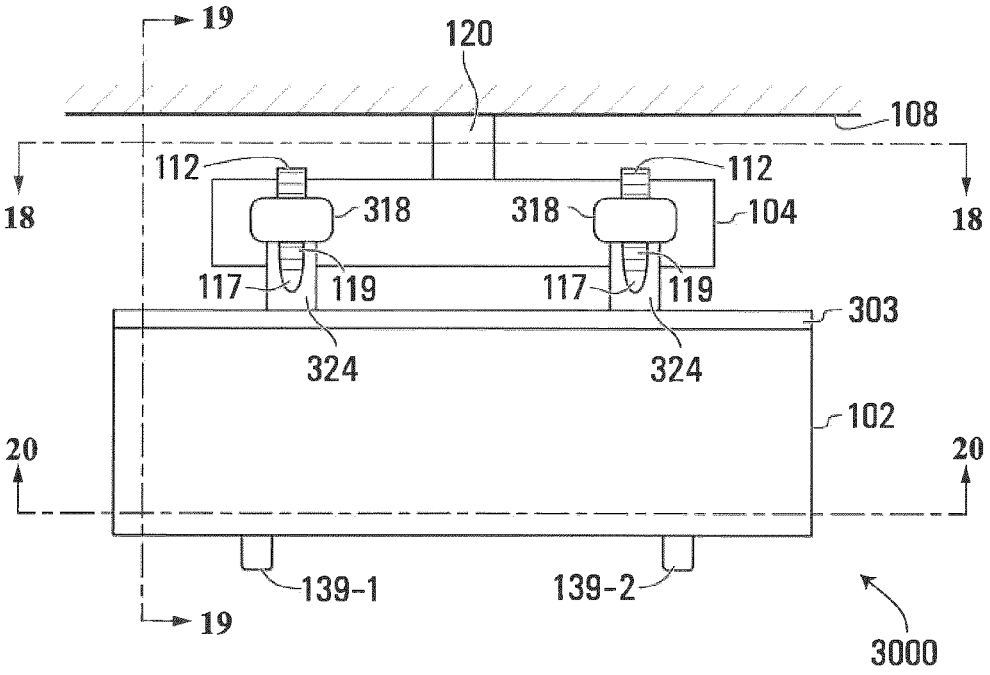
FIG. 17 is a top view of the door alarm of FIG. 16.
Figure 18:
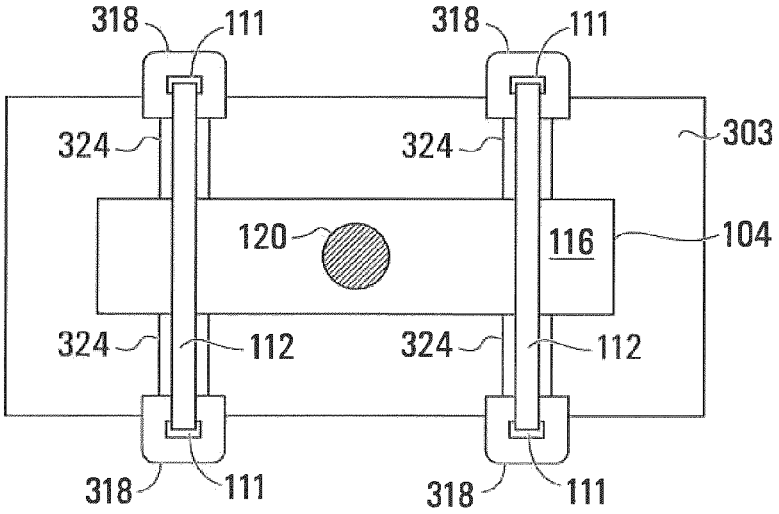
FIG. 18 is a rear view of the door alarm of FIG. 16, along line 18-18 shown in FIG. 17.

For example, FIGS. 16-18 depict a door alarm 3000 with a back plate 303 removably attached to a wall 305 of a housing 302 for example using clips (not shown). Anchor posts 324 extend from back plate 303 and define a notch for receiving thumb turn 104. Anchor posts may be attached to back plate 303 or formed integrally with back plate 303 and may be formed, for example, from metal, plastic or wood. Anchor posts 324 may be coated with a soft or tacky material such as rubber, silicone or the like, to promote frictional engagement with thumb turn 104.

Strap retainers 318 may be formed on anchor posts 324. Strap retainers 318 may be substantially identical to strap retainers 118 (FIGS. 1-4), and are configured to hold straps 112, for example, by an internal pawl engaging teeth 119 on straps 112 to define a ratchet mechanism.

Figure 19:
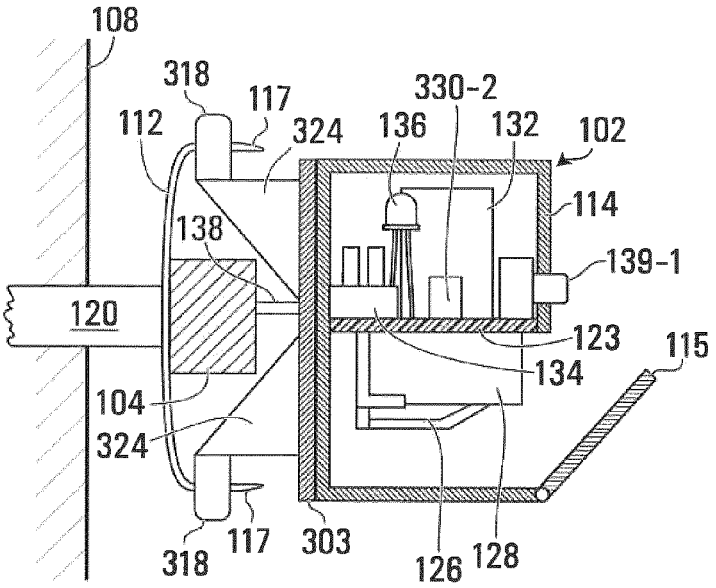
FIG. 19 is a cross-sectional view of the door alarm of FIG. 16 along the line 19-19 shown in FIG. 17.
Figure 20:
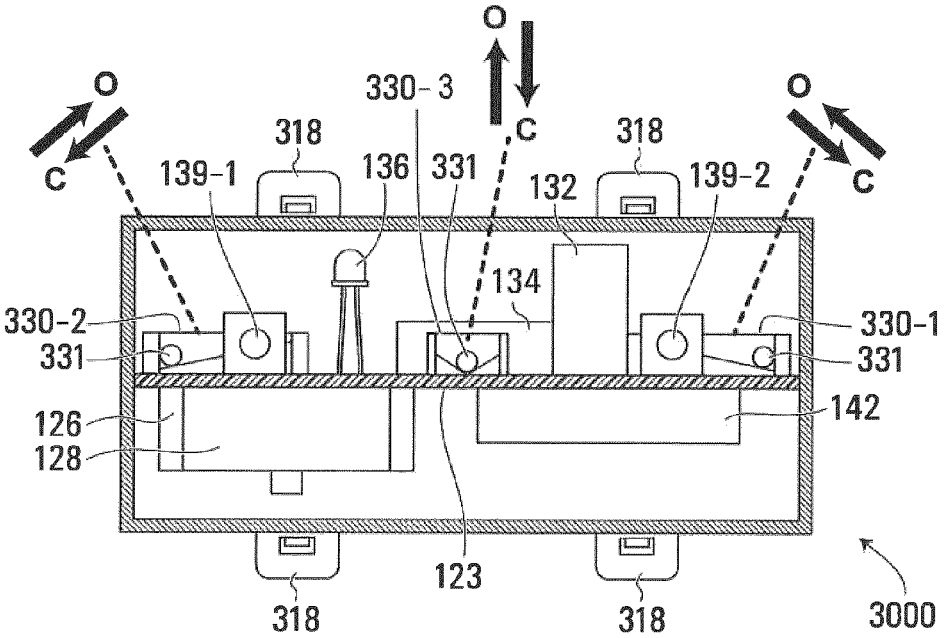
FIG. 20 is a cross-sectional view of the door alarm of FIG. 16, along the line 20-20 shown in FIG. 17, with the door alarm in a first orientation.
Figure 21:
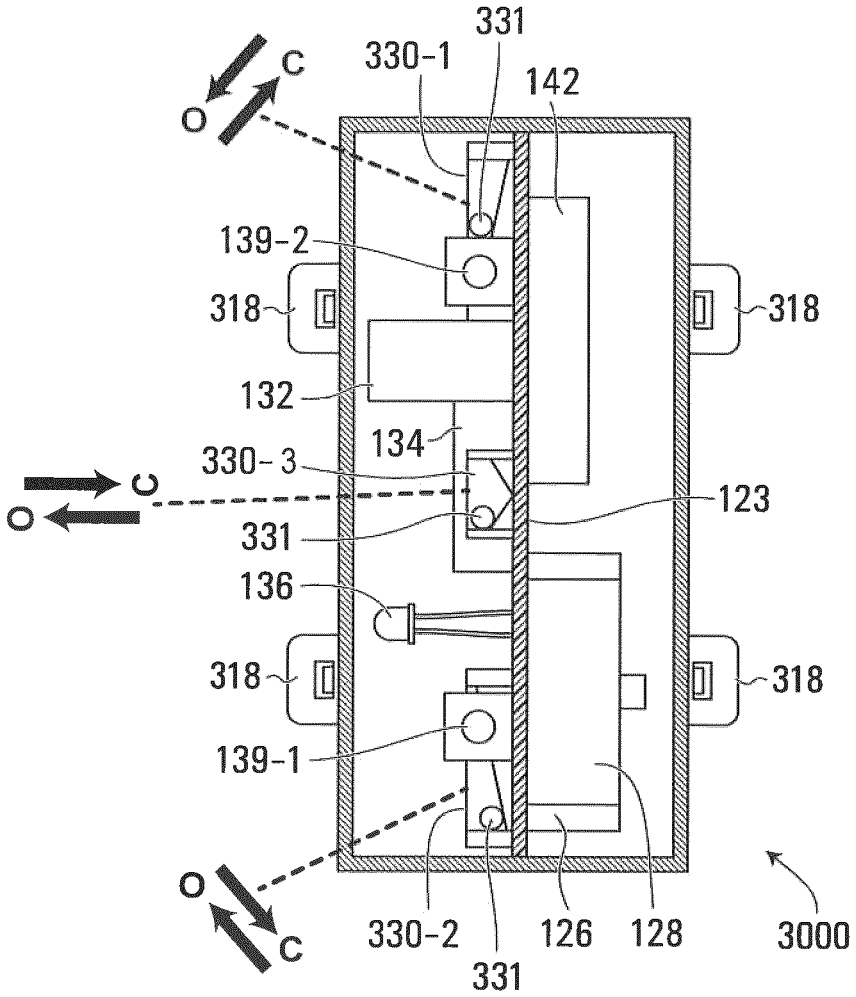
FIG. 21 is a further cross-sectional view of the door alarm of FIG. 16, along the line 20-20 shown in FIG. 17, with the door alarm in a second orientation.

Switches 130 are mounted to circuit board 123 using through-hole mounting. In some embodiments, door alarms may be constructed using tilt switches attached to circuit board 123 using a surface mount technique. As depicted in FIGS. 19-21, door alarm 3000 has surface mount tilt switches 330-1, 330-2, 330-3 (individually and collectively, surface mount tilt switches 330). Surface mount tilt switches 330 may be oriented parallel to circuit board 123. That is, in the orientation of door alarm 3000 depicted in FIG. 19, surface mount tilt switches may be oriented in a horizontal plane. Surface mount tilt switches 330 are configured to function like tilt switches 130. That is, when gravity pulls on a switch in the direction indicated by arrow O, the switch is opened (turned off). When gravity pulls in the direction indicated by arrow C, the switch is closed (turned on). Surface mount tilt switches, for example, may each have an internal ramp so that an internal movable element 331 is pulled by gravity and moved in the indicated directions. Surface mount tilt switches 330 may for example be model SQ-SEN-645β switches sold by SignalQuest LLC. As is the case with tilt switches 130, surface mount tilt switches 330 are oriented at different angles so that they each turn on and off at different orientations of door alarm 3000, and thus, each combined state of surface mount tilt switches 330 is associated with a particular range of orientations. Surface mount tilt switches 330-1, 330-2 are configured so that their opening directions are 90 degrees from one another, and surface mount tilt switch 330-3 is oriented so that its opening direction is 45 degrees from the opening directions of surface mount tilt switches 330-1, 330-2.

In some embodiments, door alarms may be constructed using a combination of surface mount and through-hole tilt switches. For example, switches 330-1 and 330-2 in door alarm 3000 may be replaced with through-hole switches like switches 130-1, 130-2.

In some embodiments, one or more supercapacitors may be provided to replace or supplement battery 128. Configurations including supercapacitors may be well suited for alarms with annunciators that draw relatively high current when activated. An annunciator may be configured to initially draw from a supercapacitor when first activated, which may mitigate sharp current peaks on initial activation of the annunciator. Such a configuration may increase battery life relative to configurations in which a high-current annunciator is powered by a battery alone.

In some embodiments, door alarms as described herein may comprise additional sensors interconnected with control unit 134. For example, control unit 134 may be interconnected with a temperature sensor, and may be configured to activate speaker 132 or send a message using transceiver 142 when the temperature sensor measures a temperature above or below a certain threshold.

As depicted, control unit 134 is a digital controller, which receives as inputs one or more signals indicating the states of tilt switches 130-1, 130-2 and which is equipped with control logic to operate the interconnected components as described above. However, in other embodiments, the door alarm may be controlled using analog circuitry.

Other modifications will be apparent to those skilled in the art and the invention is therefore defined in the claims.

What is claimed:

1. An alarm for a door having a rotary grip member comprising:

a housing having a strap retainer configured to receive a strap;

a tilt switch supported by said housing for switching when said housing is tilted;

an annunciator;

control circuitry interconnected with said tilt switch to receive an input signal from said tilt switch, said control circuitry operable to activate said annunciator dependent upon a state of said tilt switch;

a strap for retention by said strap retainer to strap said housing to said rotary grip member so that said housing rotates with said rotary grip member, wherein said strap retainer comprises a pawl and said strap comprises teeth, said pawl and said teeth forming a ratchet mechanism when said strap is received by said strap retainer.

2. The alarm of claim 1, wherein said housing comprises two pairs of strap retainers and two straps, each pair of strap retainers configured to secure one of said straps to said housing, with each strap retainer of the pair receiving an end of the strap.

3. An alarm for a door having a rotary grip member comprising:

a housing having a strap retainer configured to receive a strap;

a tilt switch supported by said housing for switching when said housing is tilted;

an annunciator;

control circuitry interconnected with said tilt switch to receive an input signal from said tilt switch, said control circuitry operable to activate said annunciator dependent upon a state of said tilt switch;

a strap for retention by said strap retainer to strap said housing to said rotary grip member so that said housing rotates with said rotary grip member, wherein said strap has a head at one end configured to receive the opposite end of said strap, said head having a pawl and said strap having teeth for forming a ratchet mechanism with said pawl when said opposite end is received by said head.

4. An alarm for a door having a rotary grip member comprising:

a housing having a strap retainer configured to receive a strap;

a tilt switch supported by said housing for switching when said housing is tilted;

an annunciator;

control circuitry interconnected with said tilt switch to receive an input signal from said tilt switch, said control circuitry operable to activate said annunciator dependent upon a state of said tilt switch;

a strap for retention by said strap retainer to strap said housing to said rotary grip member so that said housing rotates with said rotary grip member, wherein said housing comprises a pair of strap retainers and said strap is an elasticized loop for holding said housing to said rotary grip member by looping around each of said strap retainers.

5. An alarm for a door having a rotary grip member comprising:

a housing having a strap retainer configured to receive a strap;

a tilt switch supported by said housing for switching when said housing is tilted;

an annunciator;

control circuitry interconnected with said tilt switch to receive an input signal from said tilt switch, said control circuitry operable to activate said annunciator dependent upon a state of said tilt switch;

a strap for retention by said strap retainer to strap said housing to said rotary grip member so that said housing rotates with said rotary grip member, wherein said tilt switch is a first tilt switch and said alarm further comprises a second tilt switch and wherein said control circuitry is operable to activate said annunciator dependent on an on or off state of each of said first tilt switch and said second tilt switch and further comprising mode selection controls operable to select an alarm state of said first tilt switch and said second tilt switch, wherein said control circuitry is operable to activate said annunciator when said first tilt switch and said second tilt switch indicate said alarm state.

6. The alarm of claim 5, wherein said second tilt switch is oriented approximately at a 90-degree angle to said first tilt switch.

7. The alarm of claim 6, further comprising a third tilt switch, each of said first tilt switch, said second tilt switch and said third tilt switch oriented at a different angle to the horizontal, wherein said control circuitry is operable to activate said annunciator dependent on an on or off state of each of said first tilt switch, said second tilt switch and said third tilt switch.

8. The alarm of claim 7, wherein said second tilt switch is oriented approximately at a 90 degree angle to said first tilt switch and said third tilt switch is oriented approximately at a 45 degree angle to each of said first tilt switch and said second tilt switch.

9. The alarm of claim 5, wherein said mode selection controls comprise a first input device to indicate a desired armed state and a second input device to select said alarm state from among a first possible alarm state in which said alarm is rotated in a first direction relative to said armed state, and a second possible alarm state in which said alarm is rotated in a second direction, opposite to said first direction, relative to said armed state.

10. An alarm for a door having a rotary grip member comprising:

a housing having a strap retainer configured to receive a strap;

a tilt switch supported by said housing for switching when said housing is tilted;

an annunciator;

control circuitry interconnected with said tilt switch to receive an input signal from said tilt switch, said control circuitry operable to activate said annunciator dependent upon a state of said tilt switch;

a strap for retention by said strap retainer to strap said housing to said rotary grip member so that said housing rotates with said rotary grip member, wherein said control circuitry is operable to maintain a count of triggering events, and to increment said count of triggering events in response to receiving said input signal.

11. An alarm for a door having a rotary actuator comprising:

a housing coupled to the rotary actuator such that said housing rotates with said rotary actuator;

a plurality of tilt switches supported by said housing for switching when said housing is tilted, said plurality of tilt switches oriented at an angle to one another to switch at different orientations of said housing;

an annunciator;

a mode selector;

control circuitry interconnected with said plurality of tilt switches and said mode selector, said mode selector operable to select one of a plurality of possible states of said tilt switches and said control circuitry operable to activate said annunciator when said plurality of said tilt switches are in said selected state, wherein each one of said plurality of possible states corresponds to an orientation of said housing.

12. The alarm of claim 11, wherein said control circuitry stores a sequence of said plurality of possible states corresponding to a progression of possible orientations of said housing in a rotational direction.

13. The alarm of claim 12, further comprising a power switch interconnected with said control circuitry, wherein said power switch and said mode selector are operable to identify one of said plurality of states as a locked state, and wherein said mode selector is operable to select, according to a first mode, the state following said locked state in said sequence, and according to a second mode, the state preceding said locked state in said sequence.

14. The alarm of claim 13, wherein said tilt switches are oriented approximately at a 90-degree angle to one another and said progression of possible orientations comprises a progression of angular orientations spaced apart at approximately 90-degree intervals.

15. An alarm for a door having a rotary actuator comprising:

a housing coupled to the rotary actuator such that said housing rotates with said rotary actuator;

a plurality of tilt switches supported by said housing for switching when said housing is tilted, said plurality of tilt switches oriented at an angle to one another to switch at different orientations of said housing;

an annunciator;

a mode selector;

control circuitry interconnected with said plurality of tilt switches and said mode selector, said mode selector operable to select one of a plurality of possible states of said tilt switches and said control circuitry operable to activate said annunciator when said plurality of said tilt switches are in said selected state, wherein said control circuitry is operable to maintain a count of a number of times said plurality of tilt switches are in said selected state.

16. An alarm for a door having a rotary actuator comprising:

a housing coupled to the rotary actuator such that said housing rotates with said rotary actuator;

a plurality of tilt switches supported by said housing for switching when said housing is tilted, said plurality of tilt switches oriented at an angle to one another to switch at different orientations of said housing;

an annunciator;

a mode selector;

control circuitry interconnected with said plurality of tilt switches and said mode selector, said mode selector operable to select one of a plurality of possible states of said tilt switches and said control circuitry operable to activate said annunciator when said plurality of said tilt switches are in said selected state, wherein said housing forms a rotary grip member of a door.

* * * * *